US007524037B2

(12) United States Patent
Taira

(10) Patent No.: US 7,524,037 B2
(45) Date of Patent: Apr. 28, 2009

(54) INKJET RECORDING APPARATUS

(75) Inventor: Hiroshi Taira, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 411 days.

(21) Appl. No.: 11/276,104

(22) Filed: Feb. 14, 2006

(65) Prior Publication Data

US 2006/0181579 A1 Aug. 17, 2006

(30) Foreign Application Priority Data

Feb. 15, 2005 (JP) ..... 2005-037352

(51) Int. Cl.
*B41J 2/05* (2006.01)
*B41J 2/045* (2006.01)

(52) U.S. Cl. ..... 347/65; 347/71

(58) Field of Classification Search ..... 347/65, 347/68, 70, 71
See application file for complete search history.

(56) References Cited

U.S. PATENT DOCUMENTS

| | | | | |
|---|---|---|---|---|
| 5,872,583 | A * | 2/1999 | Yamamoto et al. | 347/70 |
| 6,918,661 | B2 * | 7/2005 | Ito | 347/71 |
| 7,246,889 | B2 * | 7/2007 | Kanada et al. | 347/71 |
| 2004/0021735 | A1 | 2/2004 | Horii et al. | |
| 2005/0073562 | A1 | 4/2005 | Taira | |
| 2005/0140723 | A1 | 6/2005 | Taira | |

FOREIGN PATENT DOCUMENTS

| | | | |
|---|---|---|---|
| EP | 0391570 | A2 | 10/1990 |
| EP | 1403063 | A1 | 3/2004 |
| JP | 114423 | | 4/2004 |
| JP | 2005-186383 | A | 7/2005 |

OTHER PUBLICATIONS

European Search Report for European Patent Appl'n No. 06 00 3012 (counterpart to above-captioned patent application) completed May 10, 2006.

European Patent Office, Communication Pursuant to Article 94(3) EPC in European Patent Appl'n No. 06003012.9-1251 (counterpart to above-captioned U.S. patent application) mailed Jul. 2, 2008.

* cited by examiner

*Primary Examiner*—An H Do
(74) *Attorney, Agent, or Firm*—Baker Botts L.L.P.

(57) ABSTRACT

An inkjet recording apparatus includes an inkjet head and a frame supporting the inkjet head. The inkjet head includes a channel unit is fixed to the reservoir unit and a reservoir unit. The reservoir unit includes a laminated structure in which plural plate members are laminated. The plate members include a fixed plate. In a plan view, both end portions of the fixed plate are located outside the channel unit. The fixed plate includes first and second surfaces. The first surface is closer to the channel unit than the second surface. The both end portions of the fixed plate are fixed to the frame so that the both end portions of the fixed plate face the frame and the first surface is closer to the frame than the second surface.

16 Claims, 11 Drawing Sheets

INKJET RECORDING APPARATUS

CROSS-REFERENCE TO RELATED APPLICATIONS

This application is based upon and claims the benefit of priority from Japanese Patent Application No.2005-37352 filed on Feb. 15, 2005, the entire contents of which are incorporated herein by reference.

BACKGROUND OF THE INVENTION

1. Field of the Invention

The present invention relates to an inkjet recording apparatus, which ejects ink onto a recording medium.

2. Description of the Related Art

US 2005/073562 A1 discloses an inkjet head of an inkjet recording apparatus, which ejects ink from nozzles onto a recording medium such as printing paper. This inkjet head includes a channel unit, a reservoir unit and an actuator unit. The channel unit is formed with an ink channel including a nozzle. The reservoir unit stores ink supplied to the channel unit. The actuator unit gives injection energy to the ink in the channel unit. In this inkjet head, the upper surface of the reservoir unit (reservoir member) is fixed to a frame (member), while the upper surface of the channel unit is fixed to the bottom surface of the reservoir unit. An ink ejection surface in which the nozzles open is formed on the bottom surface of the channel unit.

SUMMARY OF THE INVENTION

The channel unit has low strength because a large number of minute channels being built inside. Thus, it is worried that applying external force to the channel unit may cause deformation and/or damage of the channel unit. From the aspect of protecting the low-strength channel unit from the external force, in the case where the inkjet head is fixed to the frame, it is preferable that a distance between the frame and the channel unit in a direction perpendicular to the ink ejection surface be short, which distance constitutes the amount of exposure from a frame surface. According to US 2005/073562 A1, the high-strength reservoir unit is fixed to the frame, so that the inkjet head can be securely supported. However, the reservoir unit is arranged with respect to the frame so that the frame and the channel unit sandwich the reservoir unit therebetween. That is, since the surface of the reservoir unit opposite to the channel unit is fixed to the frame, the substantially entire channel unit is configured to protrude from the frame surface. As a result, the inkjet head is susceptible to unnecessary external force, by an amount equivalent to its protruding portion, during use and when undergoing maintenance.

The invention provides an inkjet recording apparatus, which can securely support an inkjet head as well as shortening the distance between the frame and the channel unit in a direction perpendicular to the ink ejection surface.

According to an aspect of the invention, an inkjet recording apparatus includes an inkjet head and a frame. The inkjet head includes a channel unit and a reservoir unit. The channel unit includes a common ink chamber and a plurality of individual ink channels each of which extends from the common ink chamber through a pressure chamber to a nozzle. The channel unit is fixed to the reservoir unit. The reservoir unit supplies ink to the common ink chamber. The frame supports the inkjet head. The inkjet head extends in an extending direction perpendicular to a conveyance direction of a recording medium.

The reservoir unit includes a laminated structure in which a plurality of plate members are laminated. The plurality of plate members include a fixed plate. In a plan view of the reservoir unit, both end portions of the fixed plate are located outside the channel unit. The fixed plate includes first and second surfaces. The first surface is closer to the channel unit than the second surface. The both end portions of the fixed plate are fixed to the frame so that the both end portions of the fixed plate face the frame and the first surface is closer to the frame than the second surface.

According to this configuration, the fixed plate includes the first and second surfaces. The first surface is closer to the channel unit than the second surface. The fixed plate is fixed to the frame so that the first surface of the fixed plate is closer to the frame than the second surface. Therefore, the inkjet head is securely supported by the frame, and the distance between the frame and channel unit in a direction perpendicular to the ink ejection surface in which the nozzles open can be shortened. As a result, the low-strength channel unit can be protected from an external force, which may cause distortion and breakage of the channel unit. Furthermore, since the both end portions of the fixed plate are fixed to the frame, it is easy to adjust tilting etc. of the inkjet head.

DETAILED DESCRIPTION OF EMBODIMENTS OF THE INVENTION

Embodiments of the invention will hereafter be described with reference to the drawings.

Figure 1:
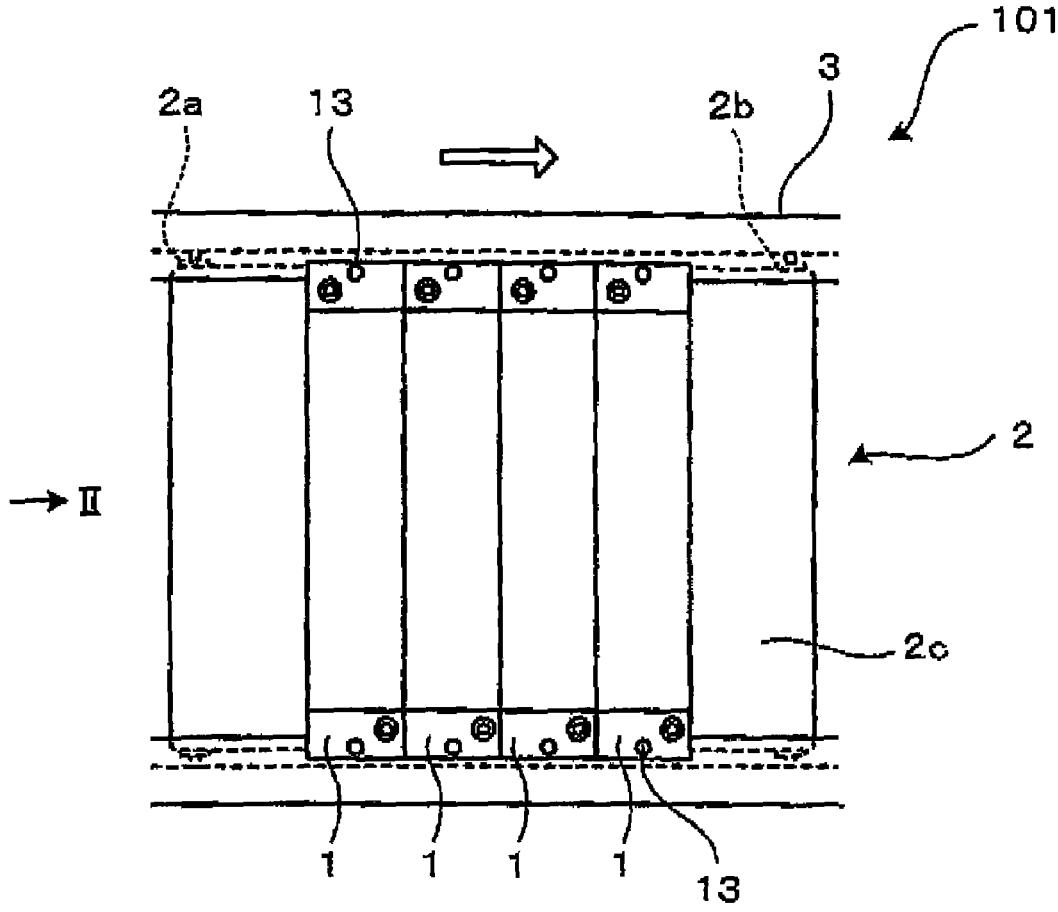
FIG. 1 is an external view of an inkjet recording apparatus according to an embodiment of the invention.

FIG. 1 is an external view of an inkjet recording apparatus according to an embodiment of the invention. As shown in FIG. 1, an inkjet recording apparatus 101 includes a conveyance mechanism 2, which conveys printing paper serving as a recording medium; four inkjet heads 1, which form an image on the printing paper conveyed by the conveyance mechanism 2 by ejecting ink droplets onto the printing paper: and a frame 3, which supports the conveyance mechanism 2 and the four inkjet heads 1.

The conveyance mechanism 2 is configured to form a conveyance path for the printing paper in which the printing paper is fed from the left side of the figure (hereafter referred to as the "paper feed side") and discharged to the right side of the figure (hereafter referred to as the "paper discharge side").

The conveyance mechanism 2 includes two belt rollers 2*a* and 2*b*, and a conveyance belt 2*c*. The two belt rollers 2*a* and 2*b* are rotatably supported so as to be parallel to each other. The belt roller 2*a* is driven by a conveyance motor (not shown). The conveyance belt 2*c* is a ring-shaped belt, which is stretched across the two belt rollers 2*a* and 2*c*. When the belt roller 2*a* is driven, the conveyance belt 2*c* is driven in a direction of an arrow shown in the figure. The peripheral surface of the conveyance belt 2*c*, that is, a conveyance surface is siliconized, so that the conveyance belt 2*c* can convey the printing paper from the paper feed side to the paper discharge side while holding the printing paper by the adhesiveness of the conveyance surface (see the white arrow in the figure).

The four inkjet heads 1 are supported by the frame 3 so as to be arranged adjacent to each other in the conveyance path along a width direction of the inkjet heads 1. The inkjet heads 1 are line heads, which extend across the conveyance path in a direction perpendicular to the conveyance direction of the printing paper. The surfaces of the inkjet heads 1 on the conveyance path side, that is, the surfaces facing the conveyed printing paper is an ink ejection surface. Furthermore, the four inkjet heads 1 are configured to eject ink droplets of colors different from each other, those colors being cyan, yellow, magenta and black. In other words, the inkjet recording apparatus 101 is a color inkjet printer.

The upper surface of the frame 3 supports both longitudinal end portions of the four inkjet heads 1. FIG. 1 shows only part of the frame 3.

Figure 2:
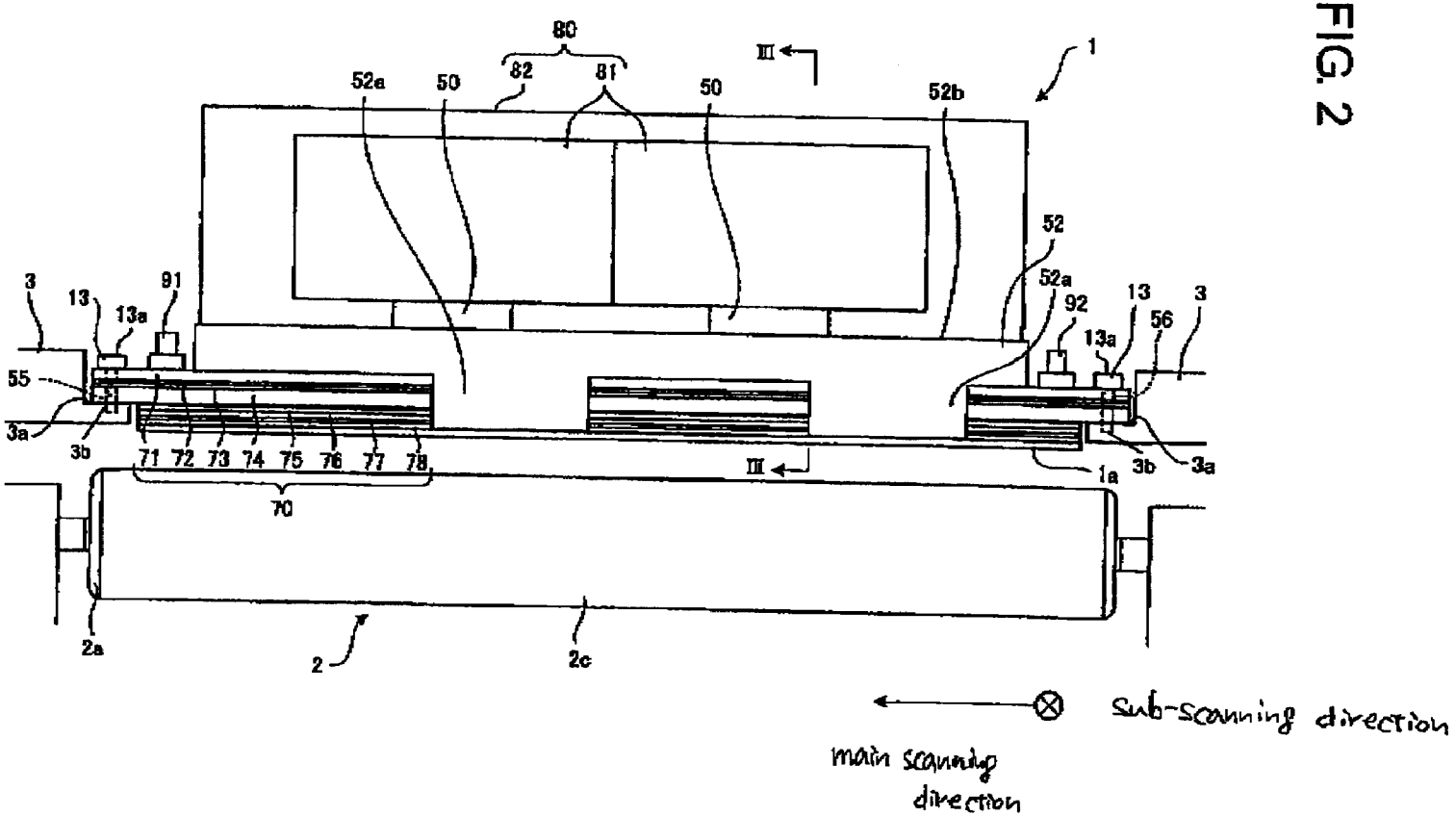
FIG. 2 is a perspective view showing inkjet heads shown in FIG. 1.
Figure 3:
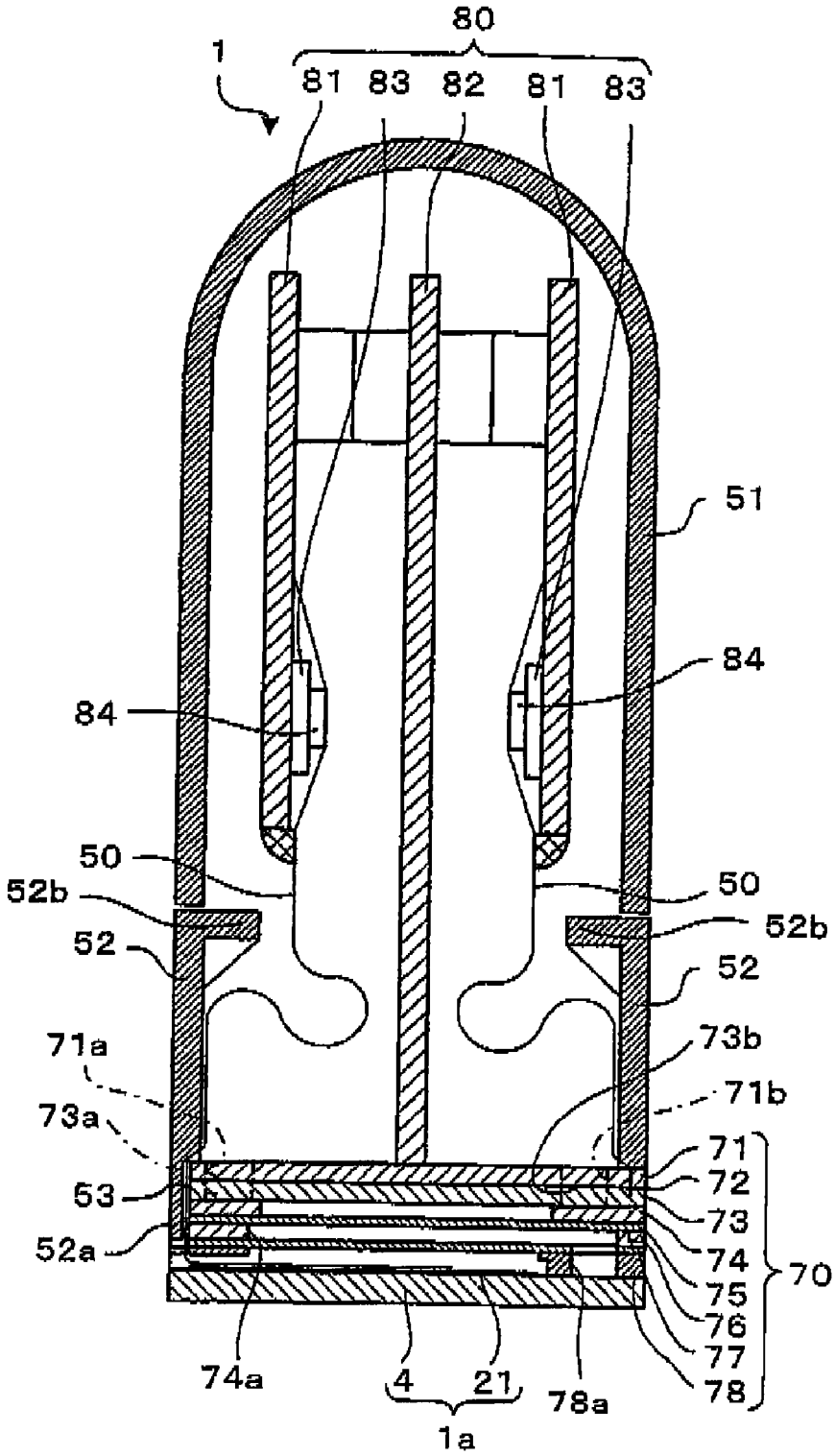
FIG. 3 is a sectional view of the inkjet heads taken along a line III-III in FIG. 2.

Next, the details of the inkjet heads 1 will be described with reference to FIGS. 2 and 3. FIG. 2 is an external view of the inkjet heads 1 as viewed from an arrow II direction shown in FIG. 1. FIG. 3 is a sectional view taken along an arrow III-III line shown in FIG. 2.

As shown in FIGS. 2 and 3, the inkjet heads 1 elongate in a main scanning direction. Each inkjet head 1 includes, in order from the bottom, a head body 1*a*, a reservoir unit 70 and a controller 80, which controls driving of the head body 1*a*. The components of the inkjet head 1 will be described in order from the top.

As shown in FIGS. 2 and 3, the controller 80 includes a main substrate 82, two sub-substrates 81 arranged one on both sides of the main substrate 82, and driver ICs 83. Each driver IC 83 is fixed to a side surface of the corresponding sub-substrate 81 opposite that of the corresponding main substrate 82. The driver IC 83 generates signals for driving an actuator unit 21, which is included in the head body 1*a*.

The main substrate 82 and the sub-substrates 81 have rectangular planar surfaces elongating in the main scanning direction, and are erected in parallel to each other. The main substrate 82 is fixed to the upper surface of the reservoir unit 70 while the sub-substrates 81 are disposed above the reservoir unit 70 at an equal distance from the both sides of the main substrate 82. The main substrate 82 and each sub-substrate 81 are connected to each other electrically. A heat sink 84 is fixed to the surface of each driver IC 83 opposite the main substrate 82.

An FPC (Flexible Printed Circuit) 50 serving as a power feeding member is drawn upwards from a lower portion of the head 1. The FPC 50 is connected at one end thereof to the actuator unit 21, and at the other end thereof to the sub-substrate 81. The FPC 50 is also connected to the heat sink 84 through the driver IC 83. In other words, the FPC 50, electrically connected to the sub-substrate 81 and driver IC 83, transmits the signals output by the sub-substrate 81 to the driver IC 83, and supplies the drive signals output by the driver IC 83 to the actuator unit 21.

The inkjet heads 1 are further provided with a upper cover 51, which covers the controller 80, and a lower cover 52, which covers the lower portion of the head 1. The covers 51 and 52 prevent ink scattering during printing from adhering to the controller 80 and the like. The upper cover 50 is omitted in FIG. 2 in order that the controller 80 can be seen.

As shown in FIG. 3, the upper cover 51 has an arch-shaped ceiling and covers the controller 80. The lower cover 52 has a substantially square tubular shape, which opens at the top and bottom, and covers a lower portion of the main substrate 82. The FPC 50 is placed loosely inside space covered by the lower cover 52 so that no stress is applied to it. At the top of the lower cover 52, a top wall 52*b* is formed projecting inwardly from the top end of the sidewall. The bottom end of the upper cover 51 is located above a connection portion between the top wall 52*b* and the sidewall. Both the lower cover 52 and the upper cover 51 have substantially the same width as the head body 1*a*.

Two projections 52*a* are formed at the lower end of each sidewall of the lower cover 52 (only one sidewall is shown in FIG. 2), which project downwardly. The two projections 52*a* are arranged in the longitudinal direction of the sidewall of the lower cover 52. The projections 52*a* are housed in concave portions 53 of the reservoir unit 70, which will be described later. Furthermore, the projections 52*a* cover a portion of the FPC 50 located in the concave portions 53. In other words, when the projections 52*a* are housed in the concave portions 53, a gap is formed therebetween so that the FPC 50 can pass through the gap. Furthermore, as can be seen from FIGS. 2 and 3, the lower end of the sidewall except the projections 52 is in contact with the upper surface of the reservoir unit 70. Tip ends of the projections 52 face the channel unit 4 of the head body 1*a* with a gap, which absorbs manufacturing error.

The vicinity of an end of the FPC 50, which is connected to the actuator unit 21, extends horizontally along the planar surface of the channel unit 4. The FPC 50 is drawn upwardly while passing through the concave portions 53 of the reservoir unit 70 and forming its bending portion.

Figure 4:
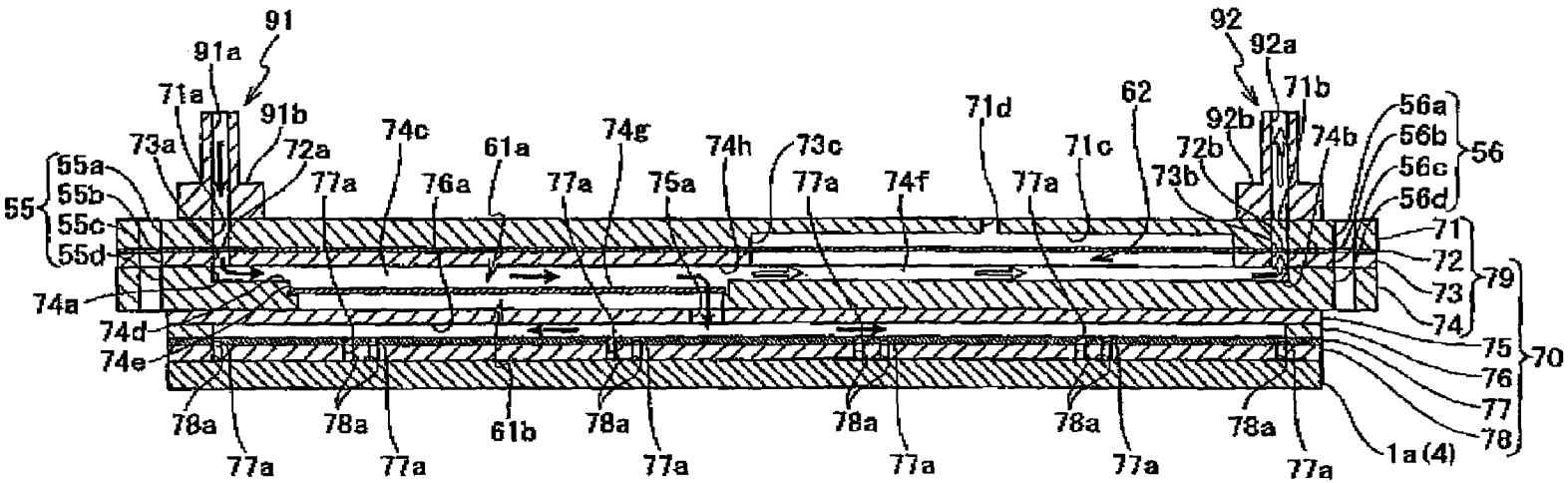
FIG. 4 is a sectional view of a reservoir unit and a head body shown in FIG. 2 taken along a main scanning direction.

Next, the reservoir unit 70 will be described with further reference to FIGS. 4 and 5. FIG. 4 is a sectional view of the reservoir head 70 and head body 1*a* taken along the main scanning direction. FIG. 5 is an exploded plan view of the reservoir unit 70. In FIG. 4, for the sake of convenience of the description, the vertical scale is enlarged. Furthermore, ink channels inside the reservoir unit 70, which is not normally depicted in a sectional diagram taken along a single line, is also shown as appropriate.

The reservoir unit 70 temporarily stores ink and supplies the ink to the channel unit 4 of the head body 1*a*. As shown in FIGS. 5A to 5H, the reservoir unit 70 has a laminated structure in which seven plates 71, 73, 74, 75, 76, 77 and 78 having a rectangular planar surface elongating in the main scanning direction (see FIG. 1), and one damper sheet 72 are laminated together. Of these components, the seven plates 71 and 73 to 78 are metal plates made of stainless steel or the like.

Figure 5A:
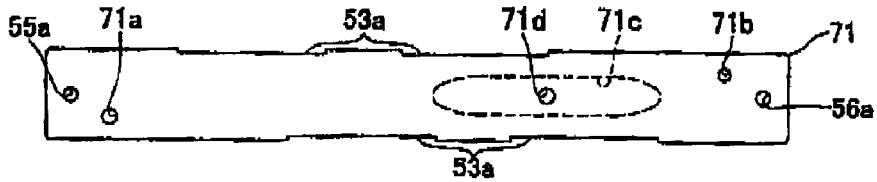
FIG. 5 is exploded plan views of the reservoir unit shown in FIG. 4.

In the first plate 71, which forms the uppermost layer, as shown in FIGS. 4 and 5A, circular holes 55*a* and 56*a* are formed respectively in a center position in the width direction and in the vicinity of both ends of the first plate 71 in the longitudinal direction. Furthermore, circular holes 71*a* and 71*b* are formed on center sides of the circular holes 55*a* and 56*a* in the longitudinal direction, respectively. The circular holes 71*a* and 71*b* are located in positions, which are shifted from the center of the first plate 71 in the width direction towards respective ends of the first plate 71 in the width direction. An elliptical concave portion 71*c* elongating in the longitudinal direction of the first plate 71 is formed on the lower surface (the surface facing the damper sheet 72) of the first plate 71. The elliptical concave portion 71*c* is located between the center of the first plate 71 in the longitudinal direction and the circular hole 56*a*. Furthermore, a circular hole 71*d* is formed in the center of the bottom of the elliptical concave portion 71*c*.

Figure 5B:
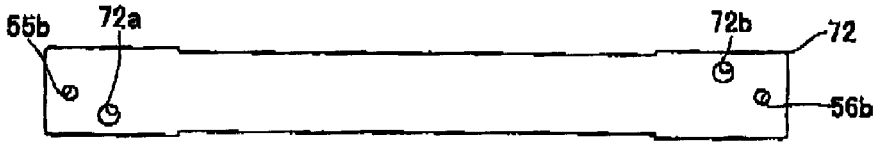

The damper sheet 72, which is the second layer from the top, is made of a flexible thin film. As shown in FIGS. 4 and 5B, circular holes 55*b* and 56*b*, which correspond to the circular holes 55*a* and 56*a* formed in the first plate 71, and circular holes 72*a* and 72*b*, which correspond to the circular holes 71*a* and 72*a* formed in the first plate 71, are formed in the damper sheet 72. Furthermore, the flexible thin film is not limited in its material to metal, resin or the like so long as the material bends easily in response to fluctuations in ink pressure. This embodiment uses a composite resin film obtained by adding a gas barrier film to PET (polyethylene telephthalate) resin intrinsically having good gas barrier property. According to this configuration, the permeation of air and moisture through the flexible thin film is almost completely suppressed, enabling the flexible thin film to function as a good damper for fluctuations in ink pressure.

Figure 5C:
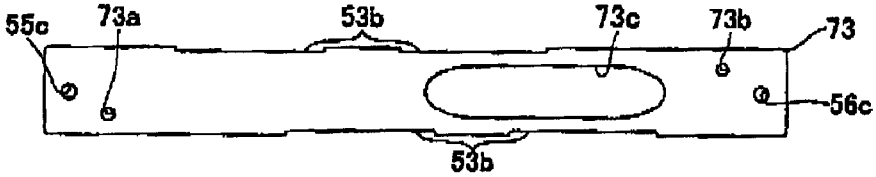

In the third plate 73, which is the third layer from the top, as shown in FIGS. 4 and 5C, circular holes 55*c* and 56*c*, which correspond to the circular holes 55*a* and 56*a* formed in the first plate 71, circular holes 73*a* and 73*b*, which correspond to the circular holes 71*a* and 72*a* formed in the first plate 71, and an elliptical hole 73*c*, which corresponds to the elliptical concave portion 71*c* formed in the first plate 71, are formed as through-holes.

Figure 5D:
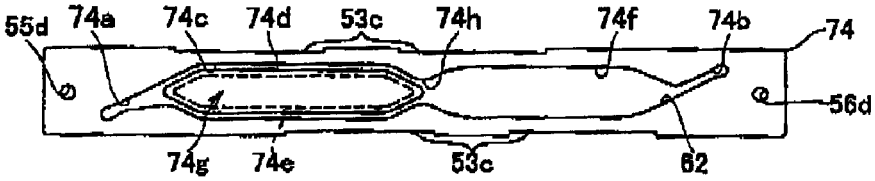

The fourth plate 74 (serving as a fixed plate), which is the fourth layer from the top, has, as shown in FIG. 4, the largest thickness of the seven plates 71, 73, 74, 75, 76, 77 and 78, and has the largest strength (rigidity). In order to have the largest rigidity, the forth plate 74 may have the largest thickness among the seven plates 71, 73, 74, 75, 76, 77 and 78. Furthermore, as shown in FIGS. 4 and 5D, circular holes 55*d* and 56*d*, which correspond to the circular holes 55*c* and 56*c* formed in the third plate 73, are formed in the fourth plate 74. Also, elongated concave portions 74*a* and 74*b* are formed to diagonally extend from the areas corresponding to the circular holes 71*a* and 71*b* formed in the first plate 71 towards the center of the fourth plate 74 in the width direction of the fourth plate 74. Also, an elliptical hole 74*c* is formed in the fourth plate 74 to extend to the center (that is, a point P shown in FIG. 5I, which is an enlarged view of FIG. 5D) of the fourth plate 74 while communicating with the elongated concave portion 74*a*. Two stepped surfaces 74*d* and 74*e* of different heights are formed around the periphery of the elliptical hole 74*c*. A filter 74*g* is provided on the stepped surface 74*e*, which is lower than the stepped surface 74*d*, and removes dust and the like from the ink. Furthermore, an elliptical concave portion 74*f* is formed in the fourth plate 74 to extend to the center of the fourth plate 74 while communicating with the elongated concave portion 74*b*. The elliptical concave portion 74*f* has an almost identical peripheral shape and size to that of the elliptical hole 73*c* formed in the third plate 73. The elliptical concave portion 74*f* opens to the third plate 73. Furthermore, the bottoms of the elongated concave portions 74*a* and 74*b*, the bottom of the stepped surface 74*c* and the bottom of the elliptical concave portion 74*f* are formed on the same plane. Also, a damper communication opening 74*h* is formed in the sidewall in the vicinity of the center of the fourth plate 74. Further, the elliptical hole 74*c* and the elliptical concave portion 74*f* communicate with each other via the damper communication opening 74*h*. The elongated concave portion 74*a* and a portion of the elliptical hole 74*c* on the plate 73 side of the stepped surface 74*e* form an upstream ink reservoir 61*a*. Furthermore, the elliptical concave portion 74*f* and the elongated concave portion 74*b* form a damper chamber 62.

Figure 5E:
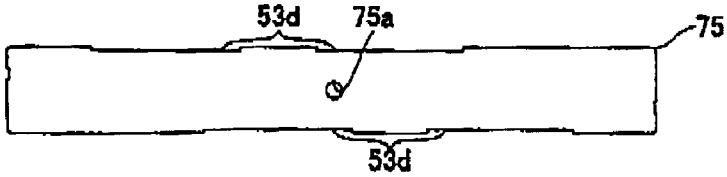

In the fifth plate 75, which is the fifth layer from the top, as shown in FIGS. 4 and 5E, a circular hole 75*a* is formed in the center thereof. The fifth plate 75 is laminated below the fourth plate 74 so that the circular hole 75*a* communicates with the through-hole 74*c* formed in the fourth plate 74. Also, the circular hole 75*a* faces an acute-angled portion of the through-hole 74*c* located in the center of the fourth plate 74.

Figure 5F:
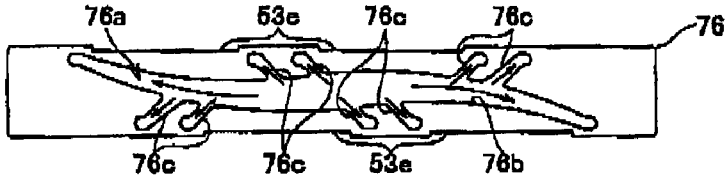

In the sixth plate 76, which is the sixth layer from the top, as shown in FIGS. 4 and 5F, a through-hole 76*a* is formed. In the plan view, the through-hole 76*a* extends while bending and tapering along the main scanning direction, and is symmetrical about its center. Particularly, the through-hole 76*a* includes a main channel 76*b*, which extends in the main scanning direction, and diverging channels 76*c*, which diverge from the main channel 76*b* and are narrower in channel width than the main channel 76*b*. Two diverging channels 76*c* extending in the same direction are paired. Two pairs of diverging channels 76*c*, which extend in different directions, protrude from each end of the main channel 76*b* in the width direction with being separate from each other in the longitudinal direction of the main channel 76*b*. Four pairs of diverging channels 76*c* are arranged in a staggered pattern. A portion of the elliptical hole 74*c* of the fourth plate 74 on the plate 75 side of the stepped surface 74*e*, the circular hole 75*a* in the fifth plate 75, and the through-hole 76*a* form a downstream ink reservoir 61*b*.

Figure 5G:
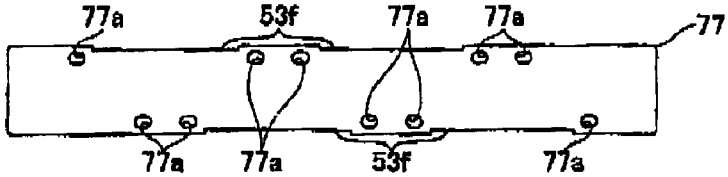

The seventh plate 77, which is the seventh layer from the top, as shown in FIG. 4, is extremely thin in comparison with the other plates. Also, as shown in FIGS. 4 and 5G, a total of 10 elliptical holes 77*a* are formed in the seventh plate 77 in positions corresponding to both ends of the main channel 76*b* in the longitudinal direction, and corresponding to tip end portions of the diverging channels 76*c* formed in the sixth plate 76. The five elliptical holes 77*a* are arranged in a staggered pattern along the longitudinal direction in the vicinity of each end of the seventh plate 77 in the width direction while being separated from each other and avoiding notches 53 described later. Specifically, one, two and two elliptical holes 77*a* are arranged on one end of the seventh plate in the width direction in the order from one end (the left end in FIG. 5G) in the longitudinal direction. Also, one, two and two elliptical holes 77*a* are arranged on the other end of the seventh plate 77 in the width direction in order from the other end (the right end in FIG. 5G) in the longitudinal direction. The elliptical holes 77*a* are symmetrical about the center of the seventh plate 77.

Figure 5H:
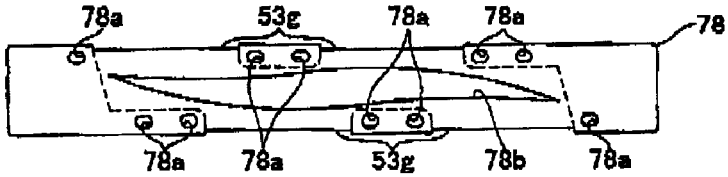
Figure 5I:
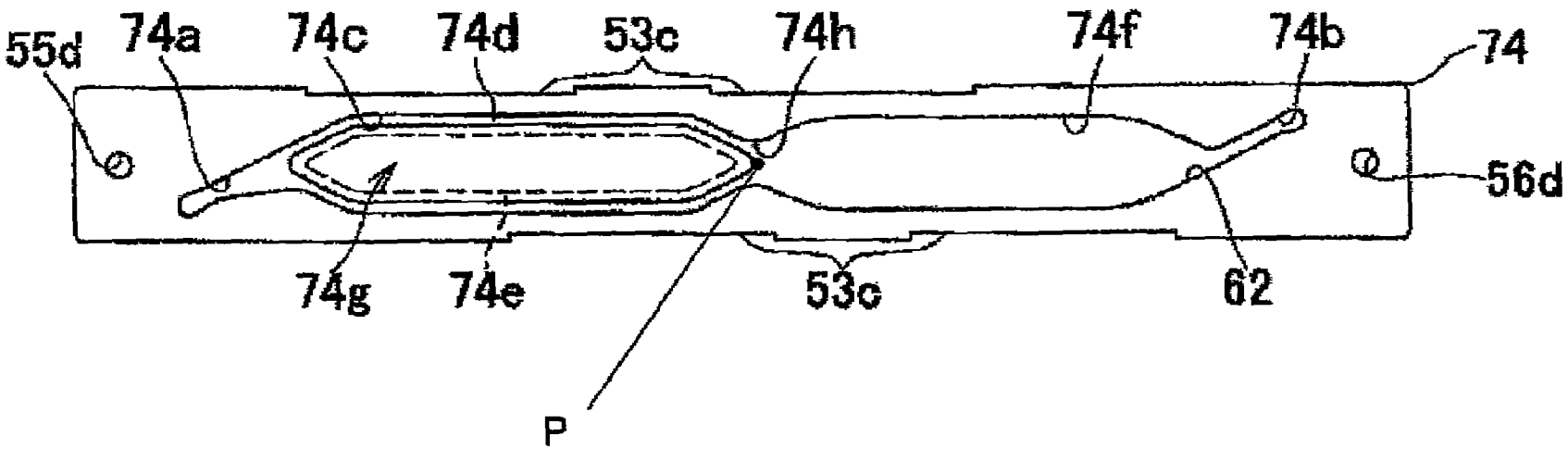

In the eighth plate 78, which forms the lowermost layer, as shown in FIGS. 4 and 5H, elliptical holes 78*a*, which correspond to the elliptical holes 77*a* formed in the seventh plate 77, and a through-hole 78*b*, which corresponds to the main channel 76*b* formed in the sixth plate 76, are formed. The through-hole 78*b* has an almost identical peripheral shape and size to that of the main channel 76*b* formed in the sixth plate 76. When the respective plates are laminated, a part of the seventh plate 77 is exposed through the through-hole 78*b*. On the lower surface of the eighth plate 78, peripheral portions of the elliptical holes 78*a* (that is, portions, which are enclosed by broken lines and a contour of the eighth plate 78 in the figure and contain the elliptical holes 78*a*) is formed so as to protrude downwards. Only these protruding portions are fixed to the upper surface of the channel unit 4, while all portions other than the protruding portions are separated from the channel unit 4 (see FIG. 3).

The seven plates 71 and 73 to 78, and the one damper sheet 72, are aligned, laminated and fixed to each other as shown in FIG. 4. At this time, the circular holes 55*a* to 55*d* and 56*a* to 56*d*, which are formed in the plates 71, 73 and 74 and the damper sheet 72, form through-holes 55 and 56, which pass in the laminating direction through a laminated structure 79 including the plates 71, 73 and 74 and the damper sheet 72. According to this embodiment, in a plan view, the plates 75, 76, 77 and 78 have a peripheral shape almost identical to the shape and size of the head body 1*a*. Both ends of the plates 71, 73 and 74 and the damper sheet 72 in the longitudinal direction protrude into outside of the head body 1*a*. The through-hole 55 is located in one of the two protruding end portions (the left side in FIGS. 4 and 5), and the through-hole 56 is located in the other of the protruding end portions.

As shown in FIG. 2, the frame 3 has counterbore portions 3*a*. An upper surface (serving as a fourth surface) of each counterbore portion 3*a* is formed with a counterbore 3*b*. The inkjet head 1 is arranged so that the upper surface of the counterbore portion 3*a* comes into contact with (faces) both end portions of the lower surface of the fourth plate 74 in the longitudinal direction. Also, screws 13, which are inserted into the through-holes 55 and 56 from the first plate 71, reach the frame 3. That is, the counterbores 3*b* receive the screws 13. Furthermore, each head 13*a* of the screw 13, which has an external diameter greater than the internal diameter of the through-holes 55 and 56, come into contact with the upper surface of the first plate 71. As a result of this, the laminated structure 79 is fixed to the frame 3. At this time, the lower surface (serving as a first surface) of the fourth plate 74 is closer to the channel unit 4 than the upper surface (serving as a second surface) of the fourth plate 74 in a direction intersecting the ink ejection surface of the inkjet body 1*a* (or, in a lamination direction of the reservoir unit 70 and the channel unit 4). Of the upper and lower surfaces of the fourth plate 74, the lower surface is closer to the frame 3 than the upper surface. Also, the ink ejection surface of the channel unit 4 is farther from the fourth plate 74 than a plane containing a lower surface (serving as a third surface) of the frame 3. At least a part of the lower surface of the frame 3 (in this embodiment, a lower surface of the counterbore portion 3*a*) is located in a region where the frame 3 (counterbore portion 3) faces the lower surface of the fourth plate 74. The lower surface of the counterbore portion 3*a* of the frame 3 is farthest from the fourth plate 74 among surfaces of the frame 3 at least parts of which are located in the region (in this embodiment, means that "among the upper and lower surfaces of the counterbore portion 3*a*). In other words, the ink ejection surface is located slightly below the lower surface of frame 3, and only a part of the channel unit 4 is exposed (protrudes) from the lower surface of the frame 3.

Furthermore, as shown in FIGS. 4 and 5, an internal space including the upstream ink reservoir 61*a*, which is a part of the ink channel, and the damper chamber 62 is formed in the laminated structure 79 configured by the plates 71, 73 and 74 and the damper sheet 72, which are longer than the channel unit 4 in the longitudinal direction. This internal space has uniform thickness. Specifically, in this embodiment, a height of a part of the internal space formed of the part of the downstream ink reservoir 61*b* and the upper ink reservoir 61*a* is equal to another part of the internal space formed of the damper chamber 62. That is, a thickness of the fourth plate 74 (a height of the elliptic hole 74*c*) is equal to a distance from the bottom of the elliptical concave portion 74*f* to the top of the elliptical concave portion 71*c*. Also, as shown in FIG. 5I, the internal space has a configuration and a shape, which are approximately symmetrical about the center point P of the laminated structure 79 in a plan view. Also, a sum (serving as a capacity of one part of the internal space) of capacity of the upstream ink reservoir 61*a*, which is formed on one side of the center point P of the laminated structure 79 in the longitudinal direction, and that of the part of the downstream ink reservoir 61*b* in the laminated structure 79 is substantially equal to a sum (serving as a capacity of the other part of the internal space) of capacity of the damper chamber 62 and that of the elliptical concave portion 71*c*, which is formed in the other side of the center point P of the laminated structure 79 in the longitudinal direction. In other words, in plan view, the one part of the internal space is located on the one side of the center point P of the laminated structure 79 fixed to the frame 3 in the longitudinal direction, and the other part of the internal space is located on the other side of the center point P. The capacity of the one part of the internal space is substantially equal to that of the other part of the internal space. Since the internal space has the uniform thickness, a thickness (height) of the one part of the internal space is substantially equal to that of the other part of the internal space. Thus, in the plan view (e.g., FIG. 5I), an area of the one part 74*a* and 74*c* of the internal space is substantially equal to that of the other part 74*b* and 74*f* of the internal space. According to this structure, the strength of the laminated structure 79 is made uniform. As described above, the laminated structure 79 includes the fourth plate 74, which has the largest strength (rigidity), so that not only can it be fixed securely to the frame 3, but also the entire inkjet heads 1 is not distorted due to the tightening force of the screws 13. Even if there is any distortion, it can be easily corrected since the strength of the laminated structure 79 is uniform without substantial difference between the left and right areas of the laminated structure 79.

Furthermore, as shown in FIGS. 5A to 5H, a total of four rectangular notches 53*a* to 53*g* are formed in a staggered pattern with two each being arranged in the longitudinal direction on both widthwise end portions of each plates 71 and 73 to 78. As the plates 71 and 73 to 78 and the damper sheet 72 can be aligned with each other at the top and bottom, the notches 53*a* to 53*g* form the concave portions 53 (see FIG. 2), which passes through the reservoir unit 70 in the laminating direction. Except the concave portion 53, the width of the reservoir unit 70 is substantially equal to that of the channel unit 4.

Next, the flow of the ink inside the reservoir unit 70 when the ink is supplied will be described.

As shown in FIG. 4, a supply joint 91 and a discharge joint 92 are fixed to positions of the upper surface of the first plate 71 where the circular hole 71*a* and 71*b* are formed. Both the joints 91 and 92 are cylindrical members having base ends 91*b* and 92*b* of a slightly larger external diameter. The joints 91 and 92 are disposed on the upper surface of the first plate 71 so that openings of cylindrical spaces 91*a* and 91*b* formed in the lower surfaces of the base ends 91*b* and 92*b* are aligned with the cylindrical holes 71*a* and 71*b* formed in the first plate 71, respectively. Flow of the ink (shown by a black arrow in FIG. 4), which is supplied through the supply joint 91, inside the reservoir unit 70 will now be described below.

As shown by the black arrow in FIG. 4, the ink, which flows through the cylindrical space 91*a* of the supply joint 91 into the circular hole 71*a*, flows into the upstream ink reservoir 61*a* through the circular holes 72*a* and 73*a*. The ink, which has flown into the upstream ink reservoir 61*a*, flows into the damper chamber 62 through the damper communication opening 74*h* while passing through the filter 74*g* and flowing into the downstream ink reservoir 61*b*. The ink, which has flown into the downstream ink reservoir 61*b*, flows down into the approximate center of the main channel 76*b* of the sixth plate 76 through the circular hole 75*a* formed in the fifth plate 75. Subsequently, as shown in FIG. 5F, the ink flows from the approximate center of the main channel 76*b* towards the both end portions of the main channel 76*b* in the longitudinal direction, and also flows towards the tip end of each diverging channel 76*c*. The ink, which has reached either the longitudinal ends of the main channel 76*b* or the tip end of each diverging channel 76*c*, flows through the elliptical holes 77*a* and 78*a* into a reception opening 5*b* (see FIG. 6), which opens in the upper surface of the channel unit 4. At the first time the ink is introduced, the ink, which has flown into the damper chamber 62, is discharged to the exterior through the discharge joint 92, whereby any air bubbles existing in the upstream ink reservoir 61*a* and the damper chamber 62 can be easily discharged. That is, the inside of the space on the upstream side of the filter 74*g* can be filled with ink having no air bubbles remaining therein.

In this way, ink is temporarily stored in the upstream ink reservoir 61*a* and the downstream ink reservoir 61*b*. Also, the opening of the circular hole 73*a* in the lower surface of the third plate 73 forms an "inlet port" of the upstream ink reservoir 61*a*, and the circular holes 71*a*, 72*a* and 73*a* form an "ink supply channel".

Next, the flow of the ink (shown by a white arrow in FIG. 4) discharged through the discharge joint 92 during back purge will be described. The back purge refers to process whereby ink or cleaning liquid is pressure-injected through nozzles 8 and, after being forced to flow along a channel in a direction opposite to that of the ink during the normal printing operation, the ink or cleaning liquid is discharged from the inkjet heads 1. By this means, cleaning of the inside of the inkjet head 1 (that is, removing foreign matters such as dust and air bubbles remaining inside the inkjet heads 1) can be carried out.

During the back purge, the cleaning liquid flows through the reception opening 5*b* into the reservoir unit 70. The cleaning liquid, which has flown into reservoir unit 70, reaches the downstream ink reservoir 61*b* via the elliptical holes 78*a* and 77*a*, then passes through the filter 74*g* and flows into the upstream ink reservoir 61*a*. As shown by the white arrow in FIG. 4, the cleaning liquid, which has flown into the upstream ink reservoir 61*a*, passes through the damper chamber 62 and circular holes 73*b*, 72*b* and 71*b*, and is discharged from the discharge joint 92. At this point, the ink existing inside the channel unit 4 and the reservoir unit 70 is pushed by the cleaning liquid, and discharged along with the cleaning liquid. At this point, the foreign matters collected by the filter 74*g* are also discharged, so that filter performance is recovered along with the cleaning of the channel.

As shown in FIG. 4, the third plate 73 forms a channel wall, which defines the damper chamber 62, and the opening of the elliptical hole 73*c* formed in the channel wall is covered by the damper sheet 72. Also, a region of the damper sheet 72, which covers the elliptical hole 73*c* faces the elliptical concave portion 71*c* formed in the first plate 71. Furthermore, the space defined by the damper sheet 72 and the elliptical concave portion 71*c* communicates with the atmosphere through the circular hole 71*d*. That is, the damper sheet 72 is interposed between the ink in the damper chamber 62 and the atmosphere. Consequently, even if a fluctuation in pressure of the ink in the reservoir unit 70 occurs, the pressure fluctuation can be attenuated by the vibration of the damper sheet 72. Furthermore, the bottom of the elliptical concave portion 71*c* regulates excessive movement of the damper sheet 72 towards the elliptical concave portion 71*c*, thus preventing damage to the damper sheet 72. Furthermore, the regulating member not only regulates the movement of the damper sheet 72, but also prevents the direct imposition of any external force, which may lead to damage of the damper sheet 72. This enables easier handling of the inkjet head 1, and also contributes to lengthening the life of the inkjet head 1.

Figure 6:
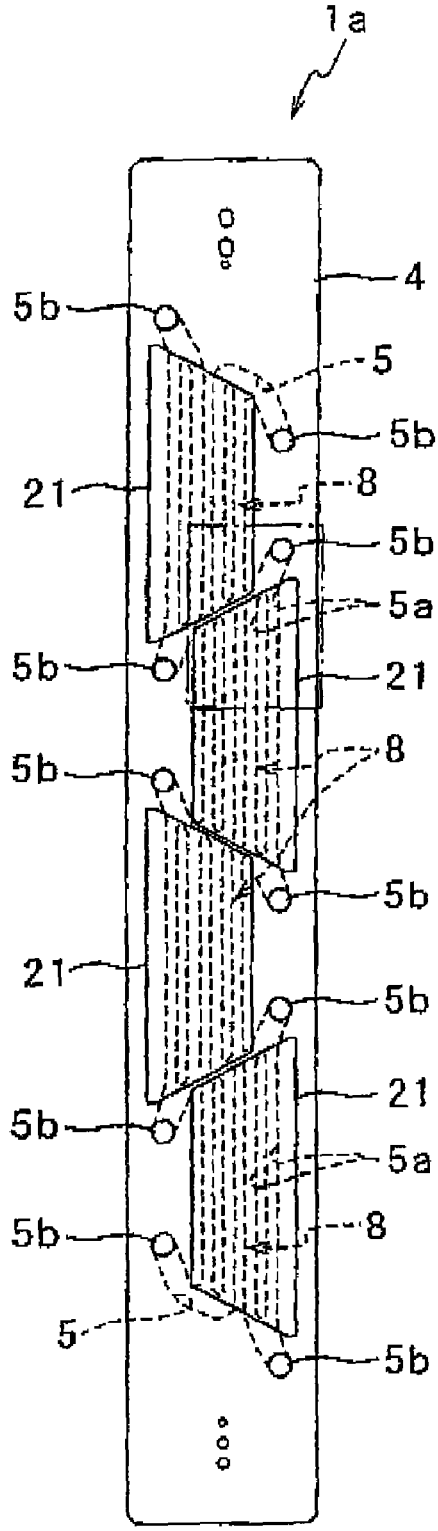
FIG. 6 is a plan view of the head body shown in FIG. 2.
Figure 7:
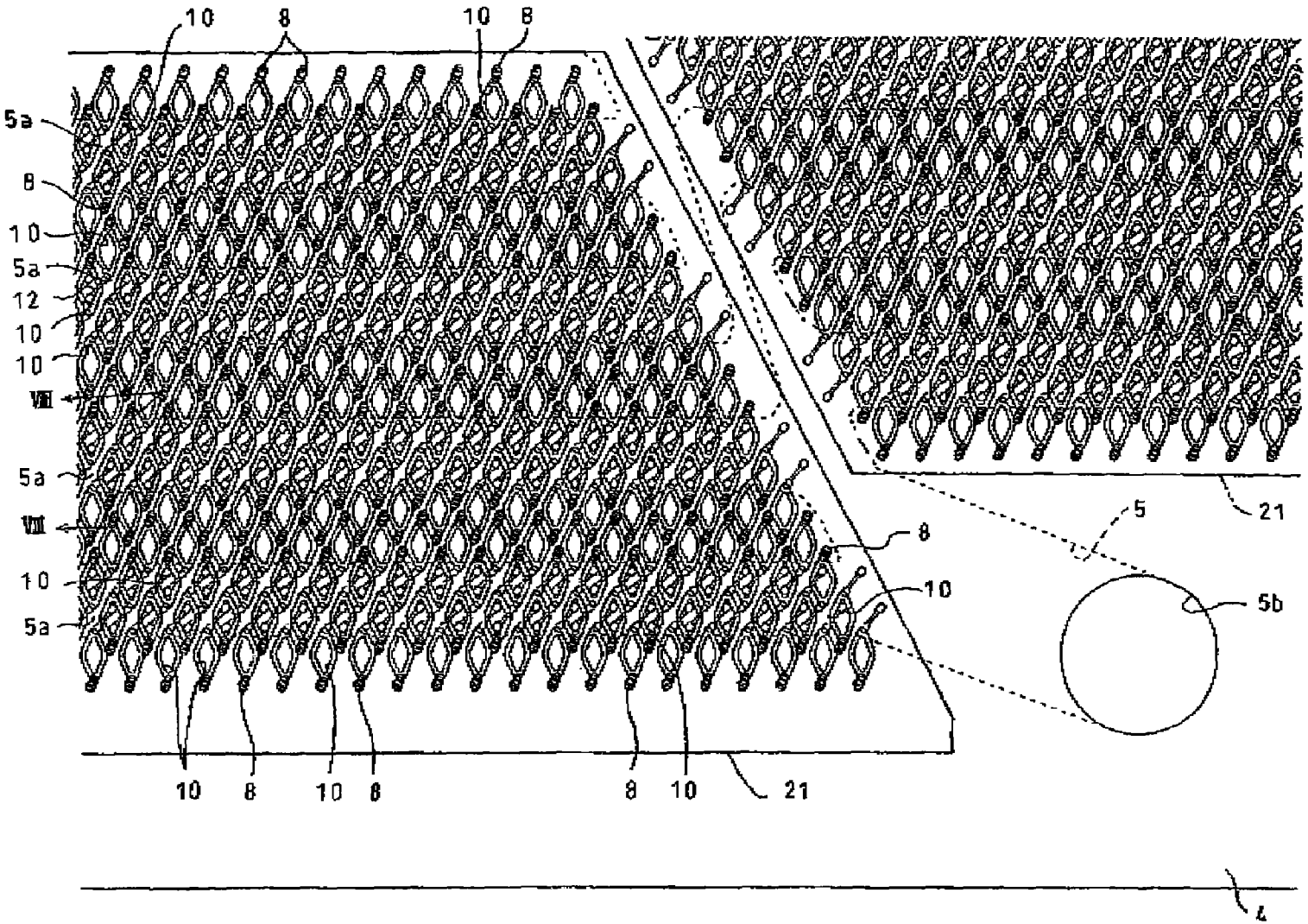
FIG. 7 is an enlarged view of an area enclosed by a chain line in FIG. 6.
Figure 8:
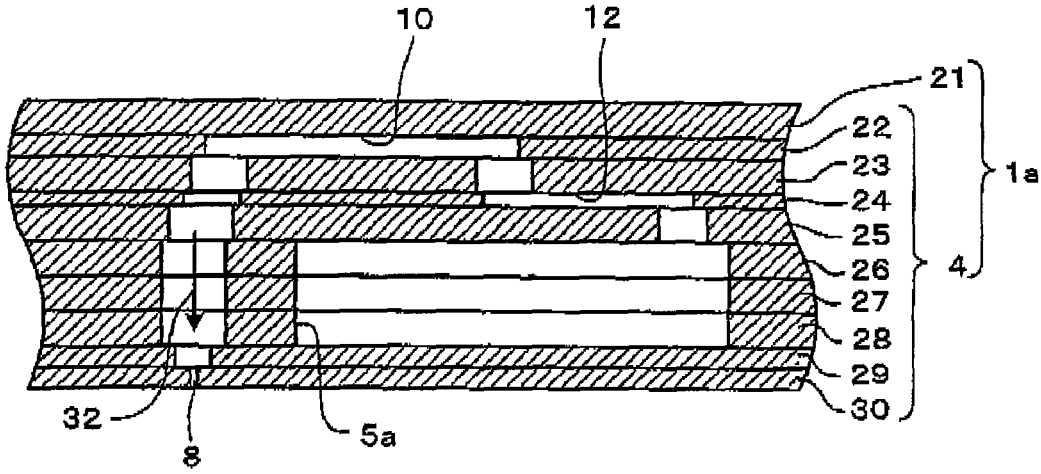
FIG. 8 is a partial sectional view taken along a line VIII-VIII in FIG. 7.
Figure 9:
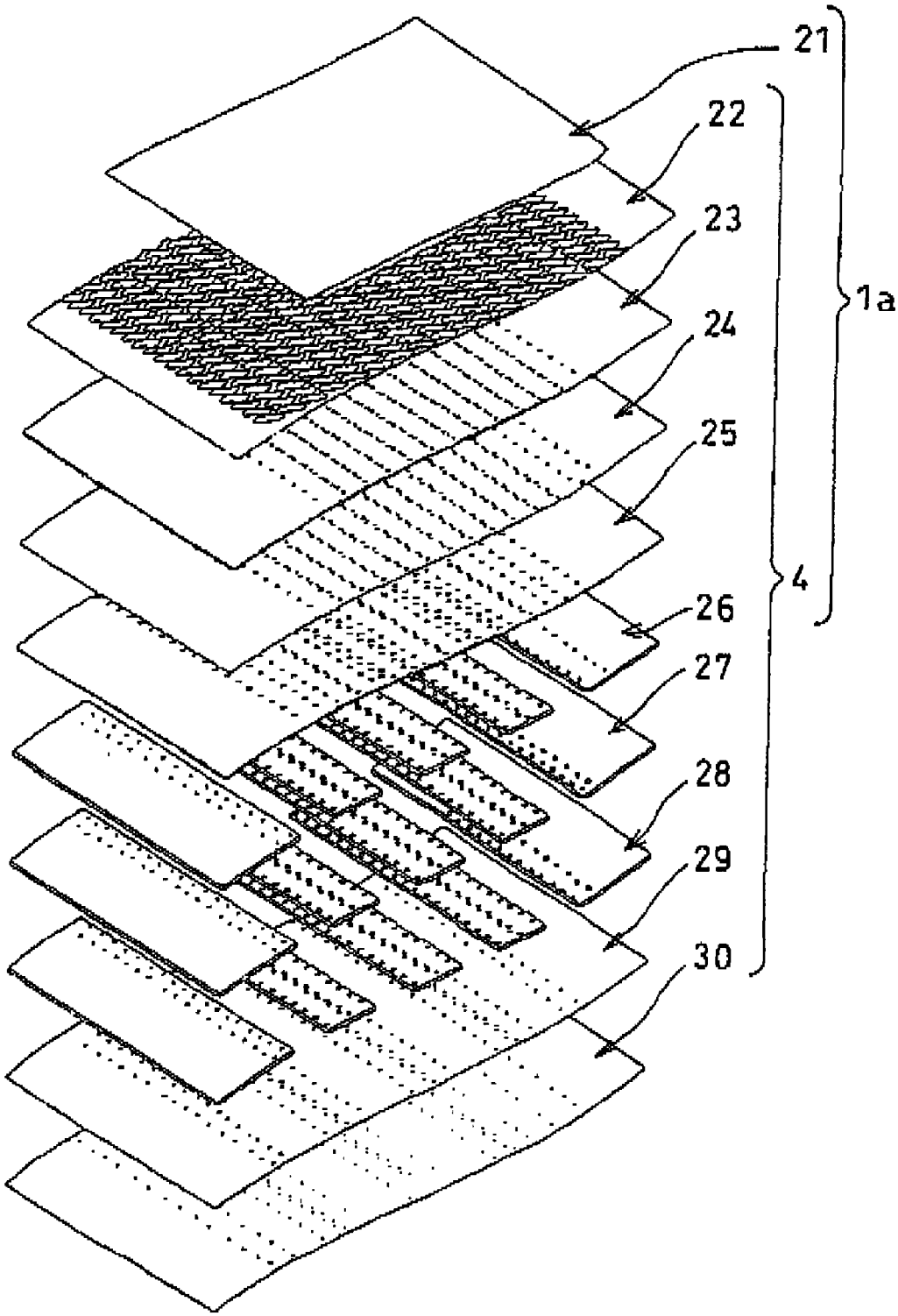
FIG. 9 is a partial exploded perspective view of the head body shown in FIG. 2.
Figure 10A:
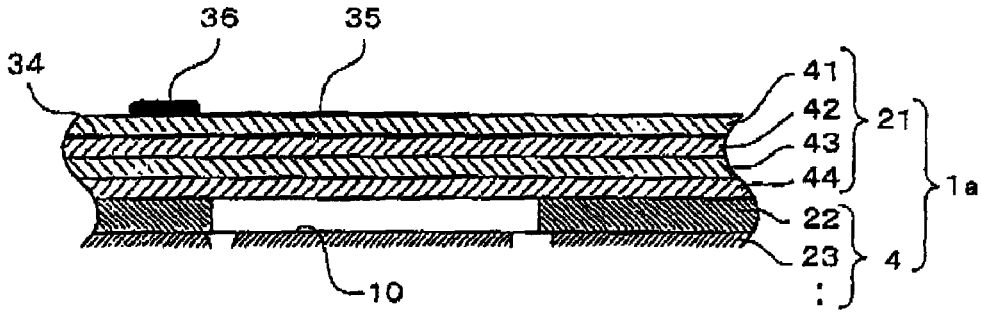
FIG. 10A is an enlarged sectional view of an actuator unit shown in FIG. 8
Figure 10B:
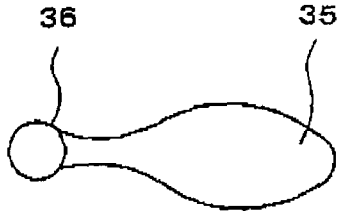
FIG. 10B is a plan view of an individual electrode arranged on a surface of the actuator unit in FIG. 10A.

Next, the head body 1*a* will be described with reference to FIGS. 6 to 10. FIG. 6 is a plan view of the head body 1*a*. FIG. 7 is an enlarged view of an area of FIG. 6 enclosed by the chain line. Also, in FIG. 7, for the sake of convenience of the description, pressure chambers 10 and apertures 12, which are located below the actuator unit 21 and should be shown by a broken line, are shown by the solid line. FIG. 8 is a partial sectional view taken along a line VIII-VIII in FIG. 7. FIG. 9 is a partial exploded perspective view of the head body 1*a*. FIG. 10A is an enlarged sectional view of the actuator unit 21. FIG. 10B is a plan view showing an individual electrode 35 arranged on the surface of the actuator unit 21 in FIG. 10A.

As shown in FIG. 6, the head body 1*a* includes the channel unit 4 and the four actuator units 21 fixed to the upper surface of the channel unit 4. The actuator units 21 have a function of selectively giving ejecting energy to the ink in pressure chambers 10 formed in the channel unit 4.

The channel unit 4 has a width approximately equal to that of the reservoir unit 70, and has a substantially parallelepiped shape, a length of which in the main scanning direction is slightly less than that of the reservoir unit 70. As shown in FIGS. 7 and 8, the ink ejection surface including the large number of nozzles 8 arranged in a matrix manner is formed on the lower surface of the channel unit 4. Similar to the nozzles 8, the large number of pressure chambers 10 are disposed in a matrix manner on the ink ejection surface.

As shown in FIG. 9, the channel unit 4 includes nine metal plates having, in order from the top, a cavity plate 22, a base plate 23, an aperture plate 24, a supply plate 25, manifold plates 26, 27 and 28, a cover plate 29 and a nozzle plate 30. The plates 22 to 30 have rectangular planes elongating in the main scanning direction (see FIG. 2).

In the cavity plate 22, a large number of through-holes corresponding to the reception openings 5*b* (see FIG. 6) and a large number of through holes, which have substantially rhombic shape and correspond to the pressure chambers 10, are formed. A communication hole between the pressure chamber 10 and aperture 12 and a communication hole between the pressure chamber 10 and nozzle 8, as well as a communication hole between the reception opening 5*b* and a manifold channel 5, are formed for each pressure chamber 10 in the base plate 23. A through-hole corresponding to the aperture 12 and a communication hole between the pressure chamber 10 and nozzle 8, as well as a communication hole between the reception opening 5*b* and manifold channel 5, are formed for each pressure chamber 10 in the aperture plate 24. A communication hole between the aperture 12 and a sub-manifold channel 5*a* and a communication hole between the pressure chamber 10 and the nozzle 8, as well as a communication hole between the reception opening 5*b* and the manifold channel 5, are formed for each pressure chamber 10 in the supply plate 25. Communication holes between the pressure chamber 10 and nozzle 8, and through-holes, which communicate with each other at the time of laminating thus to forming the manifold channel 5 and the sub-manifold channel 5*a*, are formed for each pressure chamber 10 in the manifold plates 26, 27 and 28. A communication hole between the pressure chamber 10 and the nozzle 8 is formed for each pressure chamber 10 in the cover plate 29. A hole corresponding to the nozzle 8 is formed for each pressure chamber 10 in the nozzle plate 30.

The nine plates 22 to 30 are positioned, laminated and fixed together so that an individual ink channel 32, as shown in FIG. 8, is formed in the channel unit 4.

As shown in FIG. 6, a total of ten reception openings 5*b* open onto the positions on the upper surface of the channel unit 4, which correspond to the elliptical holes 77*a* and 78*a* (see FIGS. 5G and 5G). The manifold channel 5 and the sub-manifold channels 5*a* diverging from the manifold channel 5, which communicate with the reception opening 5*b*, are formed in the channel unit 4. The individual ink channel 32 shown in FIG. 8 is formed for each nozzle 8 to extend from the manifold channel 5 through the sub-manifold channel 5*a* and the pressure chamber 10 to the nozzle 8. The ink, which is supplied from the reservoir unit 70 through the reception opening 5*b* to the channel unit 4, is diverted from the manifold channel 5 to the sub-manifold channels 5*a*, and reaches the nozzle 8 via the aperture 12, which functions as a diaphragm, and the pressure chamber 10.

As shown in FIG. 6, the four actuator units 21 have a trapezoidal planar shape. The four actuator units 21 are arranged in a staggered pattern so as to avoid the reception openings 5*b*, which open in the upper surface of the channel unit 4. The ink ejection surface corresponds to an area of the lower surface of the channel unit 4, which corresponds to the attachment area of the actuator units 21. The parallel opposite sides of each actuator unit 21 are aligned with the longitudinal direction of the channel unit 4. The oblique sides of adjacent actuator units 21 overlap each other in relation to the width direction of the channel unit 4. Furthermore, the four actuator units 21 have a relative positional relationship in which each actuator unit 21 is separated an equal distance in alternately opposite directions relative to the widthwise center of the channel unit 4.

The actuator units 21 are fixed to a portion of the upper surface of the channel 4, which faces but is separate from the lower surface of the reservoir unit 70 (see FIG. 3). The actuator units 21 are not in contact with the reservoir unit 70.

The actuator units 21 includes four piezoelectric sheets 41, 42, 43 and 44 made of a lead zirconate titanate (PZT) ceramic material with ferroelectric properties (see FIG. 10A). The piezoelectric sheets 41, 42, 43 and 44 have a thickness of approximately 15 μm. The piezoelectric sheets 41 to 44 are fixed to each other and positioned so as to straddle the large number of pressure chambers 10 formed in the channel unit 4.

Individual electrodes 35 are formed in positions corresponding to the pressure chambers 10 on the piezoelectric sheet 41, which is the uppermost layer. A common electrode 34 of a thickness of approximately 2 μm, which is formed over the entire sheet surface of the piezoelectric sheets 41 and 42, is interposed between the piezoelectric sheet 41, which is the uppermost layer, and the piezoelectric sheet 42 therebelow. Both the individual electrodes 35 and the common electrode 34 are made of a metal such as an Ag—Pd material. No electrode is provided between the piezoelectric sheets 42 and 43 or between the piezoelectric sheets 43 and 44.

Each individual electrode 35 has a thickness of approximately 1 μm. As shown in FIG. 10B, each individual electrode 35 has a substantially planar rhombic shape similar to that of the pressure chamber 10. One of the acute-angled portions of the substantially rhombic shape of individual electrode 35 is extended, and a circular land 36 of a diameter of approximately 160 μm is attached to the tip end thereof to electrically connect with the individual electrode 35. The land 36 includes, for example, a metal containing glass frit. As shown in FIG. 10B, the land 36 is attached in a position, which is located on the extended portion of the individual electrode 35 and is opposite to a position of the wall of the cavity plate 22, defining the pressure chamber 10, in the thickness direction of the piezoelectric sheets 41 to 44, That is to say, the land 36 is attached in a position, which does not overlap the pressure chamber 10 to be electrically bonded to the contact provided on the FPC 50 (see FIG. 3).

The common electrode 34 is earthed in a not-shown area. As a result of this, the common electrode 34 is maintained at an equal ground potential in the areas corresponding to all the pressure chambers 10. At the same time, the individual electrodes 35 are connected to the driver IC 83 via the FPC 50, which includes a separate and independent lead for each individual electrodes 35, and the land 36 so that the potential pertaining to each pressure chamber 10 can be controlled (see FIG. 3).

As described above, the piezoelectric sheets 41 to 44 are arranged so as to straddle the large number of pressure chambers 10, thus enabling the high density arrangement of individual electrodes 35 on the piezoelectric sheet 41 with using, for example, screen printing technology. As a result, the pressure chambers 10 formed in positions corresponding to the individual electrodes 35 can also be arranged at a high density, thus enabling the printing of a high-resolution image.

A method of driving the actuator units 21 will now be described.

The piezoelectric sheet 41 is polarized in the thickness direction. When the individual electrode 35 is set to a potential different from that of the common electrode 34 and an electrical field is applied to the piezoelectric sheet 41 in the polarization direction, the portion of the piezoelectric sheet 41 to which the electrical field is applied functions as an active portion, which distorts due to the piezoelectric effect. That is, the piezoelectric sheet 41 expands or contracts in the thickness direction and, due to the piezoelectric transversal effect, attempts to contract or expand in the planar direction. On the contrary, the remaining three piezoelectric sheets 42 to 44 are inactive layers not having an area sandwiched between the individual electrode 35 and the common electrode 34. Thus, the three piezoelectric sheets 42 to 44 are unable to distort spontaneously.

In other words, the actuator unit 21 is a so-called unimorph type, having the upper piezoelectric sheet 41, which is separated from the pressure chambers 10, as a layer including an active portion, and the three lower piezoelectric sheets 42 to 44 close to the pressure chambers 10, as inactive layers. As shown in FIG. 10A, the piezoelectric sheets 41 to 44 are fixed to the upper surface of the cavity plate 22, which defines the pressure chamber 10. Therefore, in the event that a difference in distortion between the portion of the piezoelectric sheet 41 to which the electrical field is applied and the piezoelectric sheets 42 to 44 therebelow occurs in the polarization direction, the whole piezoelectric sheets 42 to 44 deforms to protrude (unimorph deformation) towards the pressure chambers 10. Due to the resulting reduction in capacity of the pressure chambers 10, the pressure in the pressure chambers 10 rises, the ink is pushed from the pressure chamber 10 to the nozzle 8, and the ink is ejected from the nozzle 8.

Subsequently, by returning the potential of the individual electrode 35 to be equal to that of the common electrode 34, the piezoelectric sheets 41 to 44 restore to the original flat shape, and the capacity of the pressure chamber 10 returns to the original capacity. At the same time, ink is introduced from the manifold channel 5 to the pressure chamber 10, and ink is again stored in the pressure chamber 10.

As described above, according to the inkjet recording apparatus 101 of this embodiment, the lower surface of the fourth plate 74 is closer to the channel unit 4 than the upper surface of the fourth plate 74. The comparatively rigid fourth plate 74 is fixed to the frame 3 so that the lower surface of the fourth plate 74 is closer to the frame 3 than the upper surface of the fourth plate 74. Therefore, the inkjet head 1 is securely supported by the frame [3], and a distance between the frame 3 and the head body 1*a* in a direction perpendicular to the ink ejection surface can be shortened. As a result, when, for example, conducting maintenance of the apparatus, in some cases, various procedures are carried out after the inkjet heads 1 are separated from the conveyance belt 2*c* together with the whole of the frame 3. However, even in such an event, only part of the channel unit 4 protrudes from the frame 3, so that occasions at which external force is directly applied onto the channel unit 4 are reduced. In other words, although the channel unit 4 has low strength owing to the large number of minute channels built therein densely, the channel unit 4 can be protected from the external force, which may cause distortion and breakage. Furthermore, since both end portions of the laminated structure 79 in the longitudinal direction are fixed to the frame 3, it is easy to adjust tilting etc. of the inkjet heads 1.

Furthermore, since the through-holes 55 and 56 are formed in the plates 71, 73 and 74 and in the damper sheet 72, the inkjet heads 1 can be easily and securely fixed to the frame 3.

Also, the inkjet heads 1 are easily attached by inserting the screws 13 into the through-holes 55 and 56 from the plate 71 side.

Additionally, the ink ejection surface of the head body 1*a* is farther from the fourth plate 74 of the frame 3 than a plane containing a surface of the frame 3 at least a part of which is located in a region where the frame 3 faces the fourth plate 74. The surface of the frame 3 is the farthest from the fourth plate 74 among surfaces of the frame 3 at least parts of which are located in the region. Therefore, as shown in FIG. 2, even if the both end portions of the conveyance belt 2*c* in a direction perpendicular to the conveyance direction face this region of the frame 3, there is no impediment to the maintenance of clearance between the ink ejection surface and the conveyance belt 2*c*, in the vicinity of the channel unit 4 and at least in the region where the inkjet head 1 faces the frame 3. As a result, a predetermined clearance between the ink ejection surface and the printing paper can be more easily secured. Also, for example, even when carrying out printing while conveying the printing paper, reliable printing is possible due to the absence of this impediment to the conveying in the vicinity of the ink ejection surface.

Furthermore, since the upstream ink reservoir 61*a* and a part of the downstream ink reservoir 61*b* are formed in the comparatively rigid fourth plate 74, the capacity of the reservoirs can be easily secured.

Also, since the laminated structure 79 has a uniform strength, the inkjet heads 1 are more securely supported by the frame 3.

Heretofore, the embodiment has been described, but the invention is not limited to this embodiment. A variety of design changes may be made within the scope of the claims. For example, according to the aforementioned embodiment, the laminated structure 79 including the plates 71, 73 and 74 and the damper sheet 72 is fixed to the frame 3 by means of the screw 13 inserted into the through-holes 55 and 56. Alternatively, the laminated structure 79 may be fixed by a fastening member other than the screw 13. Furthermore, so long as the plate 74 is fixed to the frame 3, it is not necessary to fix the other plates to the frame 3.

Also, according to the aforementioned embodiment, the ink ejection surface of the head body 1*a* is farther from the fourth plate 74 of the frame 3 than a plane containing a surface of the frame 3 at least a part of which is located in a region where the frame 3 faces the fourth plate 74. The surface of the frame 3 is the farthest from the fourth plate 74 among surfaces of the frame 3 at least parts of which are located in the region. However, the invention is not limited to such a configuration. Alternatively, the ink ejection surface of the head body 1*a* may be arranged on this plane.

Further alternatively, the ink ejection surface of the inkjet body 1*a* may be closer to the fourth plate 74 than the plane. In this case, since the ink ejection surface is recessed into the frame 3 (the lower surface of the counterbore portion 3*a*), there is less chance that an external force is applied to the ink ejection surface of the inkjet body 1*a* during the maintenance of the inkjet head 1.

Furthermore, according to the aforementioned embodiment, the internal space of the laminated structure 79 has a uniform thickness and is substantially symmetrical about the central point of the laminated structure 79 in a plan view. Alternatively, the thickness of the internal space of the laminated structure 79 may not be uniform. Also, it is not necessary for the laminated structure 70 to be substantially symmetrical in the plan view. Also, a capacity of the one part (74*a*, 61*a*, 61*b*) of the internal space (74*a*, 61*a*, 61*b*, 62, 71*c*, 74*b*) may be different from that of the other part (62, 71*c*, 74*b*) of the internal space (74*a*, 61*a*, 61*b*, 62, 71*c*, 74*b*). In these cases, the strength of the laminated structure 79 may be uniform.

The inkjet heads according to the invention can be applied to an inkjet type facsimile and copier as well as to a printer.

What is claimed is:

1. An inkjet recording apparatus comprising:

an inkjet head that comprises:

a channel unit comprising a common ink chamber and a plurality of individual ink channels each of which extends from the common ink chamber through a pressure chamber to a nozzle; and a reservoir unit to which the channel unit is fixed, the reservoir unit supplying ink to the common ink chamber; and a frame that supports the inkjet head, wherein:

the inkjet head extends in an extending direction perpendicular to a conveyance direction of a recording medium, the reservoir unit comprises a laminated structure in which a plurality of plate members are laminated, wherein:

the plurality of plate members comprise a fixed plate, the fixed plate comprises a first end portion and a second end portion located at opposite ends of the fixed plate along the extending direction, the fixed plate comprises first and second surfaces, the first surface being closer to the channel unit than the second surface, and the both end portions of the fixed plate are fixed to the frame so that the both end portions of the fixed plate face the frame and the first surface is closer to the frame than the second surface.

2. The inkjet recording apparatus according to claim 1, wherein the fixed plate has the largest rigidity among the plate members.

3. The inkjet recording apparatus according to claim 1, wherein the fixed plate is the thickest among the plurality of plate members.

4. The inkjet recording apparatus according to claim 1, wherein the first surface of the fixed plate is in contact with and fixed to the frame at the both end portions of the fixed plate.

5. The inkjet recording apparatus according to claim 1, wherein:

the channel unit comprises an ink ejection surface in which the nozzles of the channel unit open, and the first surface of the fixed plate is closer to the frame than the second surface of the fixed plate in a direction intersecting the ink ejection surface of the channel unit.

6. The inkjet recording apparatus according to claim 1, wherein:

the reservoir unit and the channel unit are laminated to each other, and the first surface of the fixed plate is closer to the frame than the second surface of the fixed plate in a lamination direction of the reservoir unit and the channel unit.

7. The inkjet recording apparatus according to claim 1, wherein:

the fixed plate is formed with a through-hole, which passes through the fixed plate in a thickness direction of the fixed plate, and the inkjet head further comprises a fastening member inserted into the through-hole and reaching the frame.

8. The inkjet recording apparatus according to claim 7, wherein:

the fastening member comprises an expanded portion having an external diameter larger than that of an internal diameter of the through-hole, at an end of the fastening member, and the expanded portion is located on a fixed plate side with respect to a fixing surface between the fixed plate and the frame.

9. The inkjet recording apparatus according to claim 7, wherein:

the channel unit comprises an ink ejection surface in which the nozzles of the channel unit open, the frame comprises a counterbore portion formed with a counterbore that receives the fastening member, the counterbore portion comprises fourth and fifth surfaces, the fourth surface of the counterbore portion faces the fixed plate, and the ink ejection surface of the channel unit is farther from the fixed plate than the fifth surface of the counterbore portion of the frame.

10. The inkjet recording apparatus according to claim 7, wherein:

the channel unit comprises an ink ejection surface in which the nozzles of the channel unit open, the frame comprises a counterbore portion formed with a counterbore that receives the fastening member, the counterbore portion comprises fourth and fifth surfaces, the fourth surface of the counterbore portion faces the fixed plate, and the ink ejection surface of the channel unit is closer to the fixed plate than the fifth surface of the counterbore portion of the frame.

11. The inkjet recording apparatus according to claim 1, wherein:

the channel unit comprises an ink ejection surface in which the nozzles of the channel unit open, the ink ejection surface of the channel unit is farther from the fixed plate than a plane containing a third surface of the frame at least a part of which is located in a region where the frame faces the fixed plate, the third surface of the frame being the farthest from the fixed plate among surfaces of the frame at least parts of which are located in the region.

12. The inkjet recording apparatus according to claim 1, wherein:

the channel unit comprises an ink ejection surface in which the nozzles of the channel unit open, and the ink ejection surface of the channel unit is closer to the fixed plate than a plane containing a third surface of the frame at least a part of which is located in a region where the frame faces the fixed plate, the third surface of the frame being the farthest from the fixed plate among surfaces of the frame at least parts of which are located in the region.

13. The inkjet recording apparatus according to claim 1, wherein:

the reservoir unit comprises an ink reservoir that stores the ink supplied to the common ink chamber, and the fixed plate is formed with at least part of a wall surface defining the ink reservoir.

14. The inkjet recording apparatus according to claim 1, wherein more than one of the plate members including the fixed plate are fixed to the frame, the more than one of the plate members define an internal space including a channel for ink, a first part of the internal space is located on one side of a center point of the more than one of the plate members in the extending direction, a second part of the internal space is located on the other side of the center point in the extending direction, and a capacity of the first part of the internal space is substantially equal to that of the second part of the internal space.

15. The inkjet recording apparatus according to claim 14, wherein the first part of the internal space is substantially equal in thickness to the secpmd part of the internal space, and an area of the first part of the internal space is substantially equal to an area of the second part of the internal space.

16. The inkjet recording apparatus according to claim 15, wherein the internal space is substantially symmetrical about the center point.

* * * * *